US009194029B2

(12) United States Patent
Takemura

(10) Patent No.: US 9,194,029 B2
(45) Date of Patent: Nov. 24, 2015

(54) PROCESS FOR PRODUCING CAST ALUMINUM ALLOY MEMBER

(75) Inventor: Hideki Takemura, Kitakata (JP)

(73) Assignee: SHOWA DENKO K.K., Tokyo (JP)

( * ) Notice: Subject to any disclaimer, the term of this patent is extended or adjusted under 35 U.S.C. 154(b) by 1059 days.

(21) Appl. No.: 13/266,789

(22) PCT Filed: Apr. 28, 2010

(86) PCT No.: PCT/JP2010/057568

§ 371 (c)(1),
(2), (4) Date: Jan. 12, 2012

(87) PCT Pub. No.: WO2010/126085

PCT Pub. Date: Nov. 4, 2010

(65) Prior Publication Data

US 2012/0111459 A1 May 10, 2012

(30) Foreign Application Priority Data

Apr. 30, 2009 (JP) ..... 2009-111072

(51) Int. Cl.

| | |
|---|---|
| ***C22C 21/10*** | (2006.01) |
| ***C22F 1/053*** | (2006.01) |
| ***B21J 1/06*** | (2006.01) |
| ***B21J 5/00*** | (2006.01) |
| ***B21K 1/12*** | (2006.01) |
| ***B22D 11/00*** | (2006.01) |

(52) U.S. Cl.

CPC . *C22C 21/10* (2013.01); *B21J 1/06* (2013.01); *B21J 5/002* (2013.01); *B21K 1/12* (2013.01); *B22D 11/003* (2013.01); *C22F 1/053* (2013.01)

(58) Field of Classification Search

IPC ..... C22C 21/10; C22F 1/053

See application file for complete search history.

(56) References Cited

U.S. PATENT DOCUMENTS

2011/0198003 A1 8/2011 Takemura

FOREIGN PATENT DOCUMENTS

| | | | |
|---|---|---|---|
| EP | 2 034 035 | A1 | 3/2009 |
| JP | 57-158360 | A | 9/1982 |
| JP | 63-190148 | A | 8/1988 |
| JP | 2-70044 | A | 3/1990 |
| JP | 6-256880 | A | 9/1994 |
| JP | 2002-348631 | A | 12/2002 |
| JP | 2007-308769 | A | 11/2007 |
| WO | 2009/081770 | A1 | 7/2009 |
| WO | 2011/129431 | A1 | 10/2011 |

*Primary Examiner* — Roy King
*Assistant Examiner* — Janelle Morillo
(74) *Attorney, Agent, or Firm* — Keating and Bennett, LLP

(57) ABSTRACT

A production method of the present invention includes a step of obtaining an aluminum alloy melt having an alloy composition containing Fe: 0.2 to 0.35 mass %, Cu: 0.05 to 0.20 mass %, Mn: 0.3 to 0.6 mass %, Mg: 1.3 to 2.0 mass %, Zn: 4.6 to 5.1 mass %, and Zr: 0.1 mass % or more, a sum of Zr and Ti being 0.2 mass % or less, the composition satisfying a relation of ([Mg mass %]≥−0.5×[Zn mass %]+3.8) and a relation of ([Ti mass %]/[Zr mass %]≥0.2), and the balance being aluminum and inevitable impurities, and a step of obtaining an aluminum alloy ingot having a structure that has a DAS of 40 μm or less and an average crystal grain diameter of 8 μm or less by continuously casting the aluminum alloy melt at a casting rate satisfying ([maximum casting rate (mm/min)]≤−1.43×[casting diameter (mm)]+500), and a step of obtaining an aluminum alloy cast member by subjecting the aluminum alloy ingot to a homogenization treatment in which the ingot is held for 1 hour at a temperature of 450 to 600° C. By this production method, an aluminum alloy cast member free from anisotropy of plastic deformation is obtained.

6 Claims, 4 Drawing Sheets

PROCESS FOR PRODUCING CAST ALUMINUM ALLOY MEMBER

TECHNICAL FIELD

The present invention relates to a method of producing an aluminum alloy cast member used as, for example, and a forging material to be subjected to forging, and also relates to its related technologies.

TECHNICAL BACKGROUND

It is known that, when two Al—Zn—Mg series alloy members are welded, the welded portion is re-solution heat treated by the welding heat and once softened, but the strength thereof will be regained by the subsequent natural aging. Therefore, for a member that needs to be welded and also have a high strength among structural elements, an Al—Zn—Mg series alloy has been generally used.

On the other hand, a technology for producing a structural member with an aluminum alloy forged product is well known. For example, as described in Patent Document 1 listed below, a forged product is produced by forging an Al—Zn—Mg series alloy extruded member as a forging material.

Generally, when forging an Al—Zn—Mg series alloy extruded member as a forging material, the plastic deformation performance of the extruded member (forging material) at the time of the forging differs between in the extrusion direction and in a direction perpendicular to the extrusion direction, causing anisotropy of plastic deformation.

PRIOR ART DOCUMENTS

Patent Documents

Patent Document 1: Japanese Unexamined Laid-open Patent Application Publication No. S63-190148

SUMMARY OF THE INVENTION

Problems to be Solved by the Invention

On the other hand, in recent years, for the purpose of shortening a development period in a forging method, plastic deformation is simulated before producing a molding die to virtually confirm a shape of a molded member to be obtained by a forging process, and then a molding die is produced actually.

However, a generally used plastic deformation simulation software could not set up the plastic deformation performance of the forging material separately in the extrusion direction and in a direction perpendicular to the extrusion direction.

Therefore, when a forging process is conducted using a forging material having anisotropy of plastic deformation as described above, the shape of the actually forged product differs from the shape resulting from the simulation. To solve the problem, the molding die is required to be corrected, resulting in a lot of time for producing the molding die and an increased production cost. The preferred embodiments of the present invention were made in view of the above-mentioned technical background and/or other problems. The preferred embodiments of the present invention can significantly improve the existing methods and/or devices.

Furthermore, the present invention was made in view of the above problems, and aims to provide a production method for an aluminum alloy cast member capable of producing an aluminum alloy cast member which can be used as a forging member which causes no anisotropy of plastic deformation.

Another purpose of the present invention is to provide technologies relating to the production method of the above-mentioned aluminum alloy cast member, that is, a production method of an aluminum alloy forging material, a production method of an aluminum alloy forged product, and an aluminum alloy cast member. Other purposes and advantages of the present invention will become apparent from the following preferred embodiments.

Means to Solve the Problems

To achieve the abovementioned purpose, the present invention provides the following means.

[1] A production method of an aluminum alloy cast member, the method comprising:

a step of obtaining an aluminum alloy melt having an alloy composition consisting of Fe: 0.2 to 0.35 mass %, Cu: 0.05 to 0.20 mass %, Mn: 0.3 to 0.6 mass %, Mg: 1.3 to 2.0 mass %, Zn: 4.6 to 5.1 mass %, and Zr: 0.1 mass % or more, a sum of Zr and Ti being 0.2 mass % or less, the composition satisfying a relation of ([Mg mass %]≥−0.5×[Zn mass %]+3.8) and a relation of ([Ti mass %]/[Zr mass %]≥0.2), and the balance being aluminum and inevitable impurities;

a step of obtaining an aluminum alloy ingot having a structure that has a secondary dendrite arm spacing (DAS) of 40 μm or less and an average crystal grain diameter of 8 μm or less by continuously casting the aluminum alloy melt at a casting rate satisfying a condition of ([maximum casting rate (mm/min)]≤−1.43×casting diameter (mm)+500); and a step of obtaining an aluminum alloy cast member by subjecting the aluminum alloy ingot to a homogenization treatment for holding the ingot for 1 hour at a temperature of 450 to 600° C.

The casting rate is defined as a rate of pulling out the ingot from a molding die, and is obtained by measuring the moving speed of the ingot per unit of time. At the time of casting, the casting rate is gradually increased from a stopped state, and reaches a maximum speed at which the casting is in a stable condition. This maximum rate is called a maximum casting rate.

[2] A production method of an aluminum alloy forging material characterized in that the aluminum alloy cast member produced by the production method as recited in Item 1 is used as a forging material to be subjected to forging.

[3] A production method of an aluminum alloy forged product characterized in that the aluminum alloy cast member produced by the production method as recited in Item 1 is subjected to hot forging to thereby produce the aluminum alloy forged product.

[4] The production method of an aluminum alloy forged product as recited in Item 3, wherein the hot forging is executed under a temperature condition of 350 to 500° C.

[5] The production method of an aluminum alloy forged product as recited in Item 3 or 4, wherein the aluminum alloy forged product is subjected to a solution treatment at 400 to 500° C.

[6] An aluminum alloy cast member obtained by subjecting an aluminum alloy ingot to a homogenization treatment for holding the ingot for 1 hour or more at a temperature of 450 to 600° C., wherein the aluminum alloy ingot has a structure having a secondary dendrite arm spacing (DAS) of 40 μm or less and an average crystal grain diameter of 8 μm or less and obtained by continuously casting an aluminum alloy melt at a casting rate satisfying a condition of ([maximum casting rate (mm/min)]≤−1.43×[casting diameter (mm)]+500), and wherein the aluminum alloy melt has an alloy composition consisting of Fe: 0.2 to 0.35 mass %, Cu: 0.05 to 0.20 mass %, Mn: 0.3 to 0.6 mass %, Mg: 1.3 to 2.0 mass %, Zn: 4.6 to 5.1 mass %, and Zr: 0.1 mass % or more, a sum of Zr and Ti being 0.2 mass % or less, the composition satisfying a relation of ([Mg mass %]≥−0.5×[Zn mass %]+3.8) and a relation of ([Ti mass %]/[Zr mass %]≥0.2), and the balance being aluminum and inevitable impurities.

Effect of the Invention

According to the production method for an Al alloy cast member of the invention [1], an aluminum alloy cast member free from anisotropy of plastic deformation and suitably used as a forging material can be obtained.

In the present invention, "anisotropy of plastic deformation" shows the relationship between the direction of extension and the amount of elongation when a material is plastically deformed by forging or the like. The description of "free from (less) anisotropy of plastic deformation" means that the amount of elongation becomes equal (i.e., elongation becomes almost no different) even if directions are different at the time of plastically deforming as long as conditions, such as, e.g., a processing speed, a processing pressure, and a processing temperature, are the same.

According to the production method of an Al alloy forging material of the invention [2], an aluminum alloy forging material free from anisotropy of plastic deformation can be obtained.

According to the production method of an Al alloy forged product of the invention [3], an aluminum alloy forged product excellent in fracture tearing and preferably used for high-strength welding structural members can be obtained.

For the present invention, "fracture tearing", in forged products, is a mechanical property for tear, and when it is said that "fracture tearing is excellent (having good fracture tearing)", it means that the forged product does not have a portion mechanically weak in a specific direction, for example, even if a tearing load is applied in any direction in a state in which a hole is partially formed, it won't get damaged.

Furthermore, "high strength welding structure" denotes a structure suitably used for a welding structural member in which high strength is required.

According to the production method of the aluminum alloy forged product of the invention [4], forging can be performed accurately.

According to the production method of an aluminum alloy forged product of the invention [5], an even more mechanically strong forged product can be obtained.

According to the aluminum alloy cast member of the invention [6], the cast member is free from anisotropy of plastic deformation and can be suitably used as a forging material.

BEST MODE FOR CARRYING OUT THE INVENTION

Figure 1:
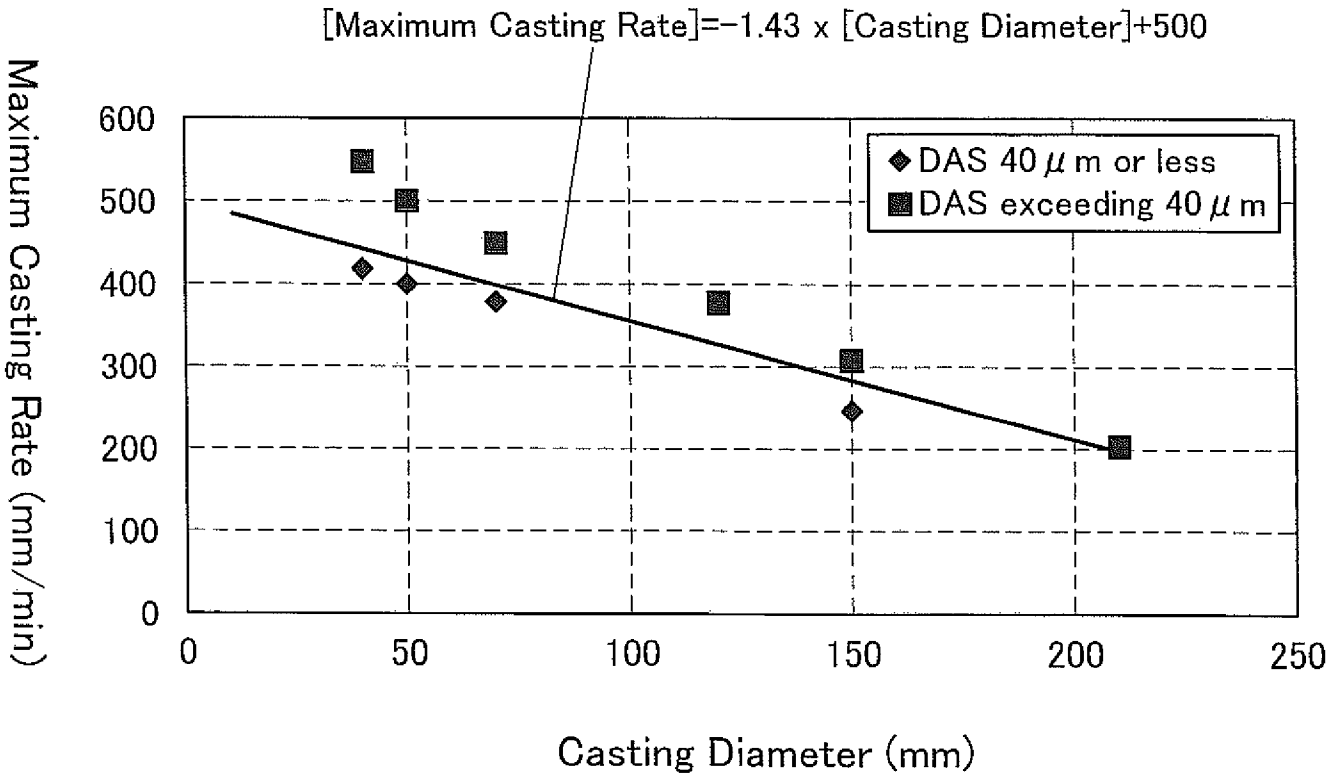
FIG. 1 is a graph showing a relation between the maximum casting rate and the DAS.

In this embodiment, an aluminum (Al) alloy cast member produced by the production method of the present invention is subjected to a forging process as a forging material.

The aluminum alloy cast member of the present invention is defined by a particular alloy composition and controlled into a particular crystal grain diameter and a distribution state in a metal structure.

The aluminum alloy cast member of this embodiment is obtained by subjecting an aluminum alloy ingot obtained by continuously casting an aluminum alloy melt having a specific composition to a predetermined homogenization treatment.

The structure of the aluminum alloy cast member of the present invention will be explained in detail below in the order of production processes.

The aluminum alloy melt as a casting material of the present invention contains Fe: 0.2 to 0.35 mass %, Cu: 0.05 to 0.20 mass %, Mn: 0.3 to 0.6 mass %, Mg: 1.3 to 2.0 mass %, Zn: 4.6 to 5.1 mass %, and Zr: 0.1 mass % or more, a sum of Zr and Ti ([Zr mass %]+[Ti mass %]) being 0.2 mass % or less, the composition satisfying a relation of ([Mg mass %]≥−0.5×[Zn mass %]+3.8) and a relation of ([Ti mass %]/[Zr mass %]≥0.2), and the balance being aluminum and inevitable impurities.

Among the alloy compositions of the present invention, Fe is an element for controlling the development of ingot breakages during a forging process and weld cracks during a welding process and also for controlling the development of recrystallization. In the present invention, the content (density) of Fe needs to be adjusted to 0.2 to 0.35 mass %.

If the content of Fe is less than 0.2 mass %, the abovementioned effects are less effective. If the content exceeds 0.35 mass %, the amount of Al—Fe—Mn series coarse crystallized grains increases, which deteriorates the plastic workability during the forging process. Furthermore, when the forged product to which forging was executed is finally assembled to a vehicle body, the extensibility (ductility), toughness, fatigue strength and impact property of the forged product (assembled member) decrease.

Cu is an element for providing a strength by being solid-soluted in an aluminum matrix to raise the degree of supersaturation of the solute in the solid solution. In the present invention, the content (density) of Cu needs to be adjusted to 0.05 to 0.20 mass %.

If the Cu content is less than 0.05 mass %, sufficient strength improving effects cannot be obtained. If the content exceeds 0.20 mass %, although strength can be improved, the resistance to stress corrosion cracking significantly deteriorates, which may cause a risk of development of weld cracks. Therefore, it is not preferable.

Mn is an element for controlling the development of coarse recrystallized grains. In the present invention, the content (density) of Mn needs to be adjusted to 0.3 to 0.6 mass %.

If the Mn content is less than 0.3 mass %, the abovementioned effects are less effective. If the content exceeds 0.6 mass %, the amount of Al—Fe—Mn series coarse crystallized grains increase, which deteriorates the plastic workability during the forging process. Furthermore, when the forged product to which forging was executed is finally assembled to a vehicle body, the extensibility (ductility), toughness, and fatigue strength of the forged product (assembled member) decrease.

Mg is an element for increasing the mechanical strength by precipitating $MgZn_2$ intermetallic compounds (η phase) by coexisting with Zn. In the present invention, the Mg content (density) needs to be adjusted to 1.3 to 2.0 mass %, and more preferably adjusted to 1.5 to 2.0 mass %.

If the Mg content is insufficient, the abovementioned effects are less effective. If the content is excessive, it is not preferable because stress corrosion cracking and quench sensitivity deteriorate.

Zn is an element for increasing the mechanical strength by precipitating $MgZn_2$ intermetallic compounds (η phase) by coexisting with Mg as explained above. In the present invention, the Zn content (density) needs to be adjusted to 4.6 to 5.1 mass %, and more preferably adjusted to 4.6 to 5.0 mass %.

If the Zn content is insufficient, the abovementioned effects are less effective. If the content is excessive, it is not preferable because stress corrosion cracking and quench sensitivity deteriorate.

Zr is an element for accelerating the crystal grain refinement of the welded part by controlling the development of coarse recrystallization. In the present invention, the Zr content (density) needs to be adjusted to 0.1 mass % or more, and the sum of the additive amount (rate of content) of Ti and Zr needs to be adjusted to 0.2 mass % or less.

If the Zr density is less than 0.1 mass %, the abovementioned effects are less effective. If Zr is added excessively, Zr reacts to B of $TiB_2$ added to refine the crystal grains during casting to create $ZrB_2$, which deteriorates crystal grain refinement. Therefore, $TiB_2$ needs to be added in large quantity. However, since $TiB_2$ and $ZrB_2$ are hard particles, a life-time of a byte (cutting tool) during cutting work is shortened when a cutting work is conducted on the forged product after forging, so it is not desirable to be added in large quantity. Thus, the Zr adding amount (density), as explained above, should be adjusted to 0.1 mass % or more, and the sum of the adding amount of Ti and Zr needs to be adjusted to 0.2 mass % or less.

In the present invention, it is more preferable that the adding amount of Ti is set to 0.03 to 0.05 mass % and the adding amount of Zr is set to 0.10 to 0.15 mass %.

Further, in the aluminum alloy composition of the present invention, Zn and Mg need to satisfy the relation of ([Mg mass %]≥−0.5×[Zn mass %]+3.8).

In detail, since Mg is an element that can easily form a chemical compound with various elements. Therefore, when a great amount of impurity elements such as Si exist, a large amount of Mg is consumed by reacting with the impurity elements, resulting in imbalance with Zn, which in turn deteriorates mechanical strength. For this reason, it is required to control the adding amount of Mg by satisfying the aforementioned relation of ([Mg mass %]≥−0.5×[Zn mass %]+3.8).

Furthermore, in the aluminum alloy composition of the present invention, between Ti and Zr, it is required to satisfy the relation of ([Ti mass %]/[Zr mass %]≥0.2).

As explained above, Zr reacts to B of $TiB_2$ added to refine the crystal grain during casting to create $ZrB_2$, which deteriorates crystal grain refinement. Therefore, if the adding amount of $TiB_2$ is insufficient with respect to the adding amount of Zr, the crystal grains become coarse during casting, which causes deterioration of the mechanical strength and extensibility (ductility), and further causes breakage of the ingot during casting. Therefore, it is necessary to control the adding amount of $TiB_2$ and Zr so that the mass ratio of Ti to Zr ([Ti mass %]/[Zr mass %]) is 0.2 or more.

In the present invention, an aluminum alloy melt having the aforementioned alloy composition is subjected to continuous casting to obtain an aluminum alloy ingot.

As a continuous casting method used in the present invention, any conventionally known continuous casting methods can be used, and a hot-top vertical continuous casting method, a gas pressure type hot-top vertical continuous casting method, and a horizontal continuous casting method can be exemplified. It is especially preferable to use a gas pressure type hot-top vertical continuous casing machine.

In the alloy composition of the present invention, at the time of the continuous casting, it is necessary to satisfy the condition of ([maximum casting rate (mm/min)]≤−1.43×[casting diameter (mm)]+500).

If the maximum casting rate is too fast, the DAS, which will be explained later, becomes coarse, and if the rate is further increased, cast breakage occurs and therefore it is undesirable. In order to obtain an ideal structure, it is required to inversely proportionate the casting rate with respect to the casting diameter. For this reason, at the time of casting, as explained above, it is required to control the casting rate so that the [maximum casting rate (mm/min)] becomes equal to or below (−1.43×[casting diameter (mm)]+500).

In the present invention, it is required to control the aforementioned aluminum alloy ingot so that the dendrite secondary arm spacing (DAS) becomes 40 μm or less.

In other words, if the DAS of the aluminum alloy ingot exceeds 40 μm, the mechanical strength deteriorates to result in undesired strength, and the average crystal grain diameter exceeds 8 μm to result in development of orange peel, causing deterioration of anisotropy of plastic deformation, and therefore it is not preferable.

The aforementioned orange peel denotes a surface unevenness that occurs on a free surface of the material not restrained by a molding die during upsetting, due to the microscopic anisotropy of plastic deformation, and can be measured with a surface roughness measuring instrument by stylus method (JIS B 0651). The occurrence of orange peel is a precursor of worsening of anisotropy of plastic deformation, and is not preferable as an evaluation of anisotropy of plastic deformation.

The mechanism of worsening of anisotropy of plastic deformation due to occurrence of orange peel is presumed as below.

A single crystal has a crystal surface only in one direction, and therefore the deformable direction is specified, which causes anisotropy at the time of being plastically deformed. In the case of a polycrystalline substance, each crystal contained in its inside has anisotropy of plastic deformation.

When a cast product containing many coarse crystal grains (e.g., a cast product in which the ingot was failed to be refined due to the inappropriately added amount of Ti—B series refiner, a cast product in which refining was failed, a cast product in which refining was failed due to the inappropriately set molten metal temperature when adding a Ti—B series refiner, and a cast product in which secondary crystallization has occurred during the homogenization treatment due to the insufficient amount of recrystallization controlling elements (Fe, Cr, Mn, Zr)) is plastically deformed, the anisotropy of plastic deformation of the coarse crystal grains in the cast product cannot be ignored. Therefore, the degree of freedom of deformation is restricted, which causes unevenness on the surface. The unevenness is 100 μm or more in 10-point average roughness Rz (JIS B 0601), and as a result, orange peel occurs. Especially on the surface not in contact with the molding die, since the plastic deformation of the surface is not restrained by the molding die, orange peel notably occurs.

As will be understood from the above, the fact that orange peel occurs means that the anisotropy of plastic deformation of the crystal in the cast product cannot be ignored, and as a result, it can be presumed that the cast product has anisotropy of plastic deformation or that anisotropy of plastic deformation is at least existed inherently.

In contrast, in cases where a cast product having no orange peel, it means that there exist many deforming directions due to many minute crystal grains in the cast product and the cast product causes no deformation in a particular direction. As a result, a free deformation can be performed. In other words, there exists no anisotropy of plastic deformation.

Consequently, in the present invention, as explained above, it is required to set the DAS to be 40 μm or less, preferably 35 μm or less, more preferably 20 μm or less.

Next, a method of controlling the size of DAS according to the present invention will be explained.

TABLE 1

| Casting diameter [mm] | Maximum casting rate [mm/min] | DAS [○: 40 μm or less, x: exceeding 40 μm] |
|---|---|---|
| 40 | 420 | ○ |
| 40 | 550 | x |
| 50 | 400 | ○ |
| 50 | 500 | x |
| 70 | 380 | ○ |
| 70 | 450 | x |
| 120 | 380 | x |
| 150 | 250 | ○ |
| 150 | 310 | x |
| 210 | 205 | x |

Table 1 shows the relationship between the maximum casting rate and the DAS. As will be understood from Table 1, there is a close relationship between the maximum casting rate and the DAS, and the size of DAS can be controlled based on the maximum casting rate. FIG. 2 is a graph showing the relationship between the maximum casting rate and the DAS, and the black diamond shaped dots show the relationship in cases where the DAS is 40 μm or less and the black square shaped dots show the relationship in cases where the DAS exceeds 40 μm. Furthermore, the graph depicts a linear line expressed by ([maximum casting rate (mm/min)]=−1.43×[casting diameter (mm)]+500). As shown in the figure, bordering the line of ([maximum casting rate (mm/min)]=−1.43×[casting diameter (mm)]+500), ingots having a DAS of 40 μm or less are positioned below the line, while ingots having a DAS exceeding 40 μm are positioned above the line. Thus, by satisfying the relationship of ([maximum casting rate (mm/min)]≤−1.43×[casting diameter (mm)]+500), as explained above, the size of DAS can be controlled to be 40 μm or less.

In the present invention, the measurement of DAS is conducted in accordance with the "Dendrite arm spacing measurement method" described in "Light Metals (1988), Vol. 38, No. 1, p 45" published by Japan Institute of Light Metals.

In the aluminum alloy ingot of the present invention, it is necessary that the average crystal grain diameter is adjusted to 8 μm or less. If the average crystal grain diameter is 8 μm or less, the plastic workability during forging becomes excellent, resulting in excellent extensibility, tenacity, and fatigue strength of the forged product.

In the present invention, crystals denote substances in which Al—Si series crystals, Al—Fe—Mn series crystals, and/or Al—Cu—Mg series crystals are crystallized in the crystal grain boundaries in a grain shape or in a leaf shape.

In the present invention, the aforementioned aluminum alloy ingot is subjected to a homogenization treatment to thereby obtain an aluminum alloy ingot.

In the present invention, the homogenization treatment is a treatment for holding the ingot for 1 hour or more at 400 to 600° C., preferably at 430 to 500° C.

If the treatment temperature for the homogenization treatment is too low, the diffusion rate of the solute atoms becomes slow, causing micro segregations, which in turn may result in deteriorated plastic workability during forging. Furthermore, if the treatment time is less than 1 hour, a time required for the solute atoms to diffuse cannot be secured, which may cause similar harmful effects caused when the treatment temperature is too low. Also, if the treatment temperature is higher than 600° C., there is a possibility that the ingot is partially dissolved, so it is not preferred.

In the meantime, during the homogenization treatment, the precipitation of Zr intermetallic compounds effective for recrystallization control progresses simultaneously. The precipitation of Zr intermetallic compounds may progress at a temperature of below 430° C., but a prolonged treatment is needed. If the temperature exceeds 500° C., even precipitation cannot be attained. Consequently, in the homogenization treatment, it is preferable to adjust the treatment temperature between 430 to 500° C.

The aluminum alloy cast member of the present invention obtained as explained above can be suitably used as a forging material.

In other words, an aluminum alloy forging product is produced by subjecting the forging material as the aforementioned aluminum alloy cast member to hot forging under temperature conditions between 350 to 500° C.

A forging member as a forging material is generally subjected to a machine work (e.g., cut process, surface layer cutting work), and also subjected to a plastic work (e.g., upsetting work) as needed.

Needless to say, the forging process can be performed multiple times.

If the temperature during the hot forging is below 350° C., the plastic workability during the hot forging deteriorates, which prevents obtaining of a forged product having a desired shape and may also cause damage of the molding die and/or breakage of the forged product. On the other hand, if the temperature during the hot forging is higher than 500° C., eutectic melting may cause hole defects near the surface of the forged product and/or aggregation of metals low in melting point. Consequently, in the present invention, the temperature during the hot forging is preferably adjusted so as to fall within the range of 350 to 500° C.

In the present invention, by subjecting the aluminum alloy forged product obtained as mentioned above to a solution treatment between 400 to 500° C., the mechanical strength of the forged product can be further improved.

In the solution treatment, if the treatment temperature is lower than 400° C., the solute amount of the precipitation hardening elements decreases, resulting in less amount of precipitation during the subsequent aging treatment, which in turn may cause insufficient mechanical strength. On the other hand, if the treatment temperature is higher than 500° C., eutectic melting may cause hole defects near the surface of the forged product and/or aggregation of metals low in melting point.

As explained above, according to the present invention, an Al—Zn—Mg alloy cast member excellent in anisotropy of plastic deformation can be obtained, and high accuracy forging can be performed using the cast member.

The cast member of the present invention can be suitably used as a forging material especially in forming a forged product having a three-dimensional complex shape, such as, e.g., a shape in which the difference between the simulation result and the actual forged product shape tends to become large (e.g., a shape in which the length in the longitudinal direction is short with respect to the length in the radial direction and a pressure is required to be applied from the side surface).

An Al—Zn—Mg series alloy forged product obtained by the present invention is excellent in fracture tearing, and can be suitably used as a member for high strength welding structures.

A product excellent in fracture tearing denotes a product having a tensile strength, a 0.2% proof stress, and an elongation after fracture in which the ratio of the characteristic deterioration in an LT direction with respect to an L direction preferably falls within 0.5%, wherein the L direction is defined as a direction parallel to a longitudinal direction of the material and the LT direction is defined as a direction perpendicular to the L direction.

As a member for a high strength welding structure, a member used for, e.g., a golf club head, a fuel tank for a motorcycle, a frame for a motorcycle, a swing arm for a motorcycle, a sub-frame for a four-wheel vehicle, a bumper beam for a four-wheel vehicle, a steering column shaft for a four-wheel vehicle, and a structural member for a railroad vehicle, can be exemplified.

Furthermore, according to the production method of the forged product of the present invention, a desired forged product can be obtained at low cost in a short development period. Moreover, the forged product obtained by the production method can be made into a product light in weight, compact in size, and high in quality. Thus, when mounted on a vehicle as a vehicle frame or the like, the maneuverability and the environmental performances of the vehicle can be further improved.

Figure 4:
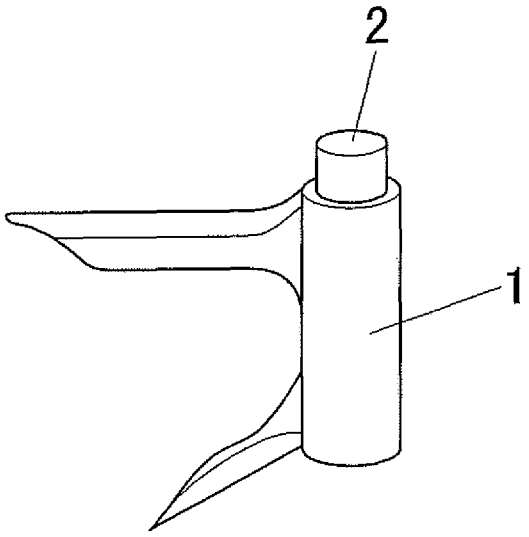
FIG. 4 is a perspective view showing an example of a motorcycle frame as an aluminum alloy forged product.

For reference, a forged product obtained by subjecting an aluminum alloy extruded member as a forging material to forging and then to T6 heat treatment, as described in Technical Background, exhibits high extensibility in a direction parallel to the extrusion direction of the extruded member, but exhibits lower extensibility in a direction perpendicular to the extrusion direction exhibits. Specifically, as shown in FIG. 4, in the case of producing a conventional motorcycle frame 1 by forging an extruded member, the extruded member exhibits high extensibility in a direction parallel to the extrusion direction, but there is a tendency that the extensibility is low in a direction perpendicular to the extrusion direction. This means that the mechanical strength in a particular direction is low, which makes it difficult to obtain a sufficient fracture tearing. Consequently, in a motorcycle frame 1 as a conventional forged product, the portion to which a shaft 2 is inserted and fixed must be designed so that the measurement in a direction perpendicular to the extrusion direction is larger with respect to the extrusion direction to control fracture tearing. For that reason, the shaft fixing portion must be increased in size, which may result in a larger and heavier motorcycle frame 1.

In contrast, a motorcycle frame 1 as a forged product obtained in accordance with the present invention is excellent in mechanical strength such as anisotropy of plastic deformation, therefore even if the shaft fixing potion is small in size, the possible fracture tearing can be assuredly prevented, which enables to attain reduction in size and weight of the motorcycle frame itself. This in turn can attain reduction in size and weight of the entire motorcycle.

Example 1

TABLE 2

| | | Alloy composition (mass %), balance: Al and inevitable impurities | | | | | | | Casting diameter | Maximum casting rate | 1.43 * diameter + 500 | Material production | Homogenization | Casting temperature | Solution treatment temperature |
|---|---|---|---|---|---|---|---|---|---|---|---|---|---|---|---|
| | | Fe | Cu | Mn | Mg | Zn | Ti | Zr | (mm) | (mm/min) | (referenece) | method | treatment | | |
| Example | 1 | 0.26 | 0.14 | 0.41 | 1.86 | 4.87 | 0.039 | 0.15 | 70 | 380 | 400 | Continuous casting | 560° C. × 7 Hr | 450° C. | 460° C. |
| | 2 | 0.24 | 0.10 | 0.39 | 1.75 | 4.65 | 0.028 | 0.11 | 70 | 380 | 400 | Continuous casting | 470° C. × 7 Hr | 400° C. | 470° C. |
| | 3 | 0.25 | 0.10 | 0.40 | 1.45 | 4.98 | 0.048 | 0.12 | 70 | 380 | 400 | Continuous casting | 530° C. × 7 Hr | 460° C. | 465° C. |
| | 4 | 0.22 | 0.15 | 0.58 | 1.93 | 4.75 | 0.080 | 0.11 | 70 | 380 | 400 | Continuous casting | 560° C. × 7 Hr | 450° C. | 460° C. |
| | 5 | 0.22 | 0.15 | 0.58 | 1.60 | 4.65 | 0.080 | 0.11 | 70 | 380 | 400 | Continuous casting | 560° C. × 7 Hr | 450° C. | 460° C. |
| | 6 | 0.26 | 0.14 | 0.41 | 1.86 | 4.87 | 0.060 | 0.12 | 50 | 400 | 429 | Continuous casting | 560° C. × 7 Hr | 450° C. | 460° C. |
| | 7 | 0.26 | 0.14 | 0.41 | 1.86 | 4.87 | 0.060 | 0.12 | 40 | 420 | 443 | Continuous casting | 560° C. × 7 Hr | 450° C. | 460° C. |
| Comparative Example | 1 | 0.26 | 0.14 | 0.41 | 1.86 | 4.87 | 0.060 | 0.12 | 210 | 205 | 200 | Extrusion | 560° C. × 7 Hr | 450° C. | 460° C. |
| | 2 | 0.24 | 0.10 | 0.39 | 1.75 | 4.65 | 0.060 | 0.12 | 210 | 205 | 200 | Extrusion | 470° C. × 7 Hr | 400° C. | 470° C. |
| | 3 | 0.25 | 0.10 | 0.40 | 1.55 | 4.52 | 0.060 | 0.12 | 210 | 205 | 200 | Extrusion | 530° C. × 7 Hr | 460° C. | 465° C. |
| | 4 | 0.26 | 0.15 | 0.42 | 1.35 | 4.65 | 0.060 | 0.12 | 70 | 380 | 400 | Continuous casting | 560° C. × 7 Hr | 450° C. | 460° C. |
| | 5 | 1.00 | 0.11 | 1.60 | 1.95 | 4.86 | 0.060 | 0.12 | 70 | 380 | 400 | Continuous casting | 560° C. × 7 Hr | 400° C. | 460° C. |
| | 6 | 0.24 | 0.14 | 0.40 | 1.76 | 4.81 | 0.030 | 0.08 | 70 | 380 | 400 | Continuous casting | 560° C. × 7 Hr | 450° C. | 460° C. |
| | 7 | 0.25 | 0.15 | 0.41 | 1.75 | 4.80 | 0.020 | 0.15 | 70 | 380 | 400 | Continuous casting | 560° C. × 7 Hr | 450° C. | 460° C. |
| | 8 | 0.23 | 0.13 | 0.39 | 1.25 | 4.98 | 0.060 | 0.12 | 70 | 380 | 400 | Continuous casting | 560° C. × 7 Hr | 450° C. | 460° C. |
| | 9 | 0.26 | 0.14 | 0.41 | 1.86 | 4.87 | 0.060 | 0.12 | 70 | 380 | 400 | Continuous casting | 670° C. × 7 Hr | 450° C. | 460° C. |

TABLE 2-continued

| | Alloy composition (mass %), balance: Al and inevitable impurities | | | | | | | Casting diameter | Maximum casting rate | 1.43 * diameter + 500 | Material production | Homogenization | Casting temperature | Solution treatment temperature |
|---|---|---|---|---|---|---|---|---|---|---|---|---|---|---|
| | Fe | Cu | Mn | Mg | Zn | Ti | Zr | (mm) | (mm/min) | (referenece) | method | treatment | | |
| 10 | 0.26 | 0.14 | 0.41 | 1.86 | 4.87 | 0.060 | 0.12 | 70 | 380 | 400 | Continuous casting | 560° C. × 7 Hr | 250° C. | 460° C. |
| 11 | 0.26 | 0.14 | 0.41 | 1.86 | 4.87 | 0.060 | 0.12 | 70 | 380 | 400 | Continuous casting | 560° C. × 7 Hr | 450° C. | 350° C. |
| 12 | 0.24 | 0.10 | 0.39 | 1.75 | 4.65 | 0.028 | 0.11 | 120 | 380 | 328 | Continuous casting | 560° C. × 7 Hr | 450° C. | 460° C. |
| 13 | 0.26 | 0.14 | 0.41 | 1.86 | 4.87 | 0.039 | 0.15 | 150 | 310 | 286 | Continuous casting | 560° C. × 7 Hr | 450° C. | 460° C. |
| 14 | 0.26 | 0.15 | 0.42 | 1.75 | 5.25 | 0.060 | 0.12 | 70 | 380 | 400 | Continuous casting | 560° C. × 7 Hr | 450° C. | 460° C. |
| 15 | 0.26 | 0.15 | 0.42 | 2.50 | 4.80 | 0.060 | 0.12 | 70 | 380 | 400 | Continuous casting | 560° C. × 7 Hr | 450° C. | 460° C. |
| 16 | 0.25 | 0.15 | 0.41 | 1.75 | 4.80 | 0.154 | 0.15 | 70 | 380 | 400 | Continuous casting | 560° C. × 7 Hr | 450° C. | 460° C. |
| 17 | 0.26 | 0.14 | 0.41 | 1.86 | 4.87 | 0.039 | 0.15 | 70 | 450 | 400 | Continuous casting | 560° C. × 7 Hr | 450° C. | 460° C. |
| 18 | 0.26 | 0.14 | 0.41 | 1.86 | 4.87 | 0.060 | 0.12 | 50 | 500 | 429 | Continuous casting | 560° C. × 7 Hr | 450° C. | 460° C. |
| 19 | 0.26 | 0.14 | 0.41 | 1.86 | 4.87 | 0.060 | 0.12 | 40 | 550 | 443 | Continuous casting | 560° C. × 7 Hr | 450° C. | 460° C. |

Next, Examples and Comparative Examples of the present invention will be explained in detail with reference to Table 2 and FIGS. 2A and 2B.

Figure 2A:
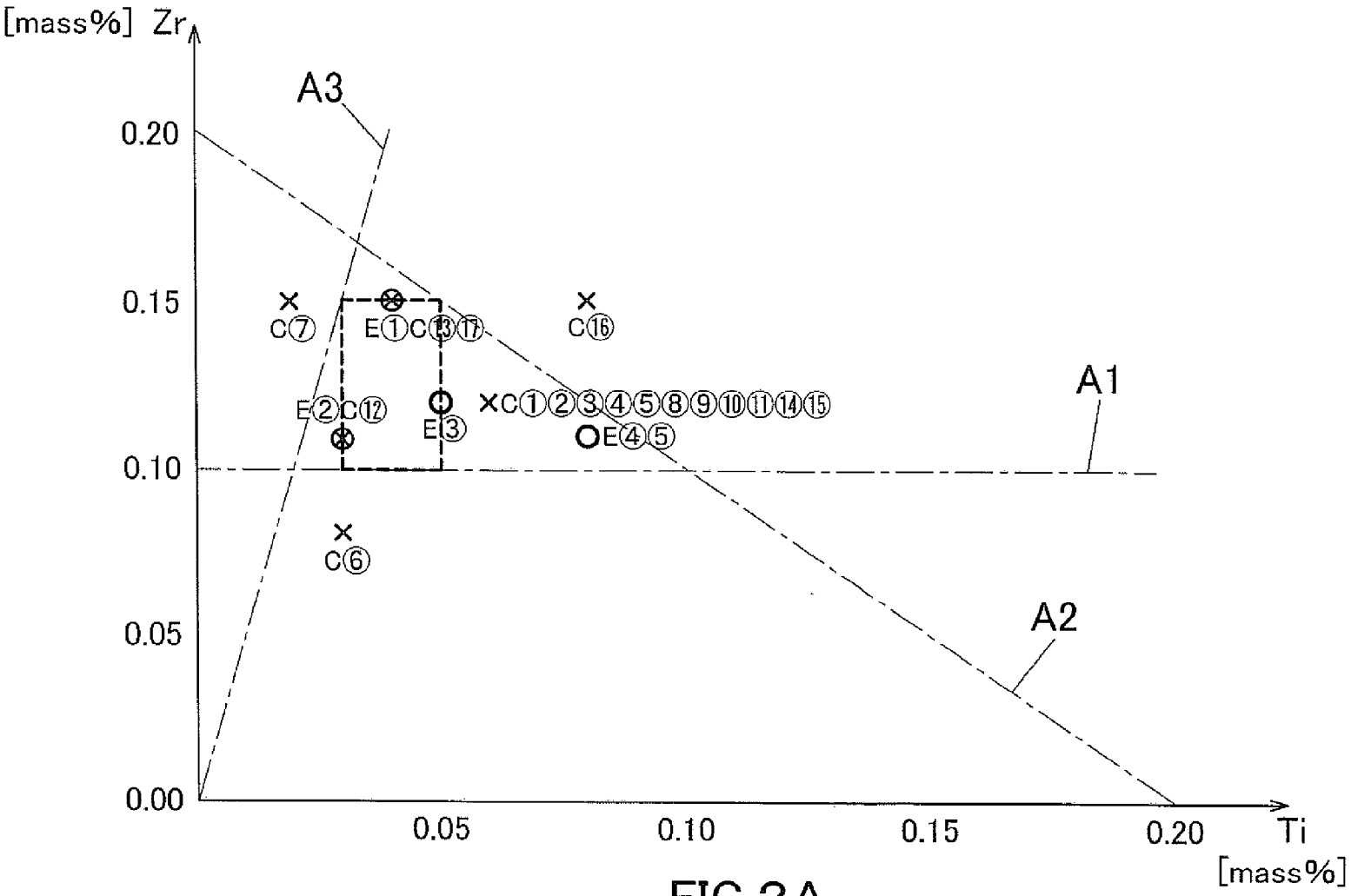
FIG. 2A is a graph showing a relation between the Zr content and the Ti content in the alloy composition of each sample of Examples and Comparative Examples.

FIG. 2A is a graph showing the relationship between Zr content and Ti content of the alloy composition in each sample of Examples and Comparative Examples. In this graph, "E" denotes Example, "C" denotes Comparative Example, a circled numeral denotes each number of Examples and Comparative Examples, and Examples are shown with "○" and Comparative Examples are shown with "x." Furthermore, in the graph, the line segment A1 represents ([Zr mass %]=0.1 mass %), the line segment A2 represents ([Ti mass %]+[Zr mass %]=0.2 mass %), and the line segment A3 represents ([Ti mass %]/[Zr mass %]=0.2). Consequently, the area surrounded by the segment lines A1 to A3 is a range corresponding to the gist of the present invention satisfying the relationship between Zr and Ti. Furthermore, the area surrounded by the dotted lines in FIG. 2A is a preferable range in the present invention.

Figure 2B:
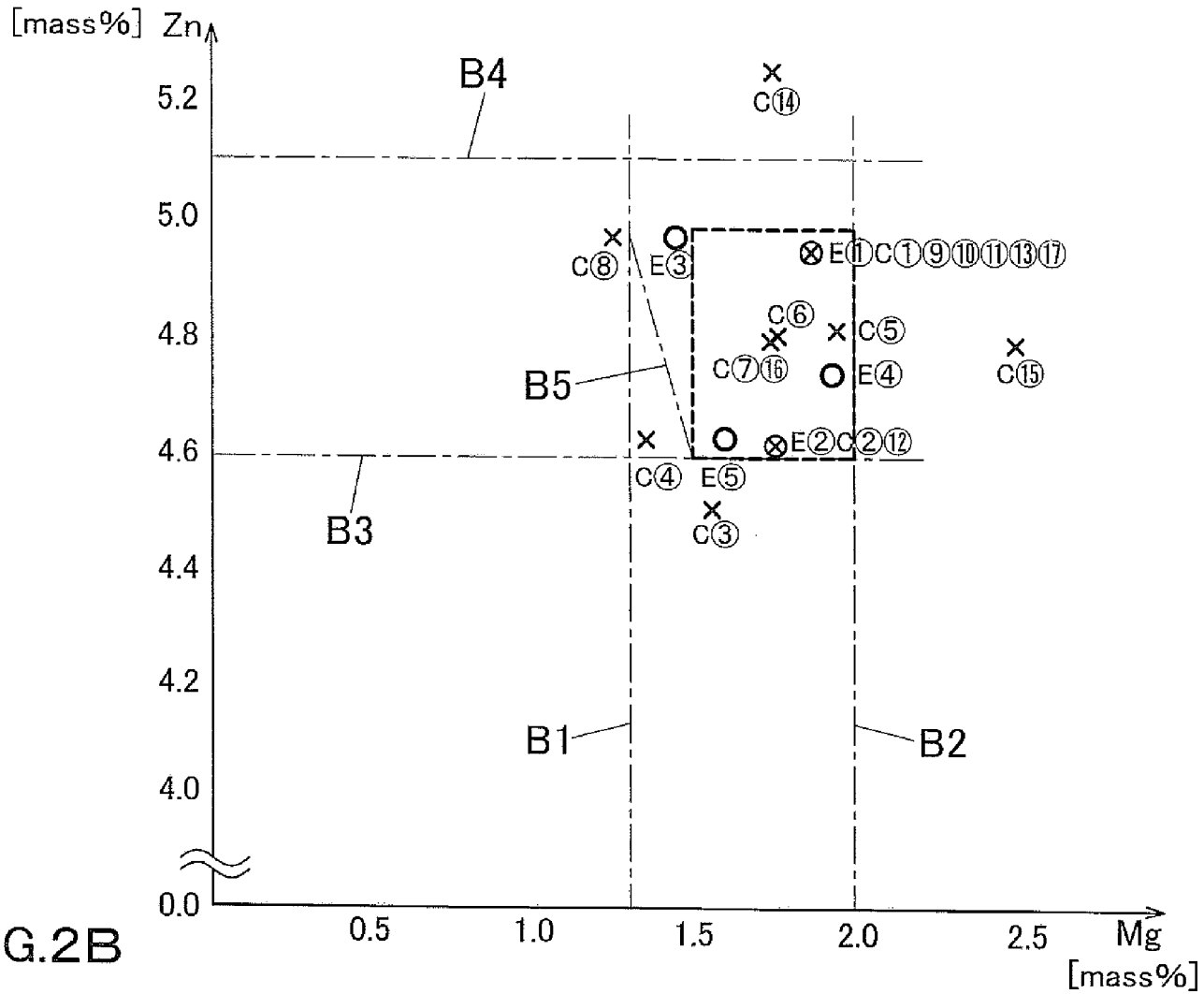
FIG. 2B is a graph showing a relation between the Zn content and the Mg content in the alloy composition of each sample of Examples and Comparative Examples.

FIG. 2B is a graph showing the relationship between Zn content and Mg content of the alloy composition in each sample of Examples and Comparative Examples. In the graph, "E" denotes Example, "C" denotes Comparative Example, circled numbers denote each numbers of Examples and Comparative Examples, and Examples are shown with "○" and Comparative Examples are shown with "x." Furthermore, in the graph, the line segment B1 represents ([Mg mass %]=1.3), the line segment B2 represents ([Mg mass %]=2.0), the line segment B3 represents ([Zn mass %]=4.6), the line segment B4 represents ([Zn mass %]=5.1), and the line segment B5 represents ([Mg mass %]=−0.5×[Zn mass %]+3.8). Consequently, the area surrounded by the line segments B1 to B5 is a range corresponding to the gist of the present invention satisfying the relationship between Zn and Mg. Furthermore, the area surrounded by the dotted line in FIG. 2B is an preferable range in the present invention.

Examples 1 to 7, Comparative Examples 4 to 19

As shown in Table 2 and FIGS. 2A and 2B, in order to produce each sample of Examples 1 to 7 and Comparative examples 4 to 19, an aluminum alloy having a composition corresponding to that of each sample was molten, and subjected to a degasification treatment and an inclusion removal treatment using flux, and thereafter, in order to prevent refinement defects of the ingot due to reaction of Ti and Zr, Ti—B refinement material was added in the degasification furnace immediately before casting.

Figure 3:
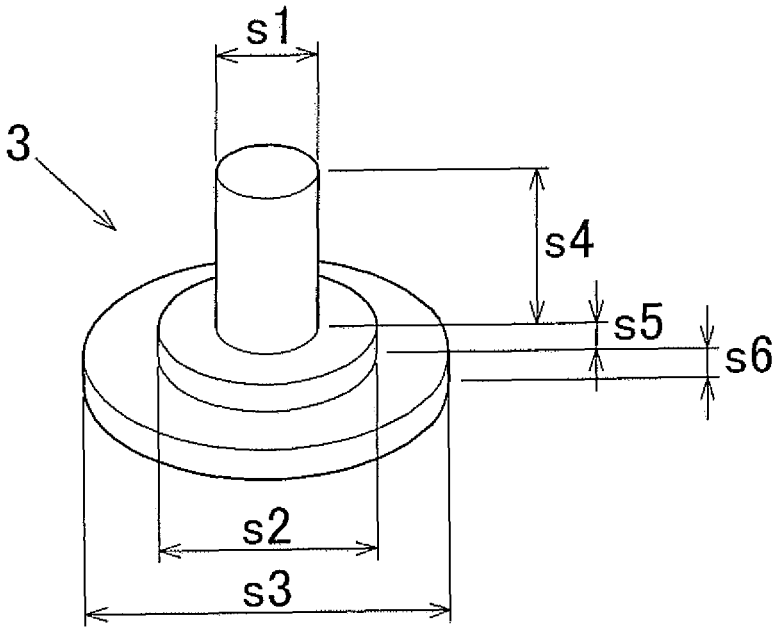
FIG. 3 is a perspective view showing a disk sample to be analyzed in alloy composition.

An aluminum alloy melt corresponding to each sample obtained in the abovementioned manner was cast in a molding die to obtain a disk sample 3 having a shape as shown in FIG. 3. The disk sample 3 was analyzed in accordance with an emission spectro-photometric analysis method defined by JIS H 1305.

Sizes S1-S6 of the disk samples 3 were as follows: s1 was 18 mm, s2 was 30 mm, s3 was 50 mm, s4 was 35 mm, s5 was 5 mm, and S6 was 5 mm.

After confirming that each sample had the targeted component values shown in FIG. 2 in view of the results of the analyses, the aluminum alloy melt corresponding to each sample was subjected to continuous casting to produce an aluminum alloy cast member (ingot) corresponding to each sample using a gas pressurization type hot top casing machine. As for the casting conditions of the casting, a round bar having a diameter shown in Table 2 was continuously cast at the casting rate shown in Table 2 while adjusting the molten metal temperature immediately before casting to be the liquidus temperature (650° C.) or above.

The ingot corresponding to each sample obtained as mentioned above was subjected to outer peripheral cutting with a lathe so that the diameter becomes 60 mm, then cut into a specified length, and subjected to a homogenization treatment under the conditions shown in Table 2. Next, the continuously cast round bar after the homogenization treatment was cut into 80 mm length to produce a forging material corresponding to each sample.

After being preheated under the conditions shown in Table 2, the forging material was upset from the side surface of the round bar to have a thickness of 35 mm. Thereafter, the upset product (forged product) was subjected to a T6 heat treatment under the conditions shown in Table 2. Thus, the forged product samples corresponding to Examples 1 to 7 and Comparative Examples 4 to 19 were produced.

Comparative Examples 1 to 3

In order to produce each sample of Comparative Examples 1 to 3, in the same manner as mentioned above, an aluminum alloy melt corresponding to each sample was prepared, and a disk samples 3 were obtained in the same manner as mentioned above. The component values for each sample were analyzed.

After confirming that each sample had the targeted component values shown in FIG. 2 in view of the results of the analyses, the aluminum alloy melt corresponding to each sample was subjected to continuous casting to produce an aluminum alloy cast member (ingot) corresponding to each sample using a gas pressurization type hot top casing machine. As for the casting conditions during the casting, a round bar having a diameter of 210 mm was continuously cast at the casting rate shown in Table 2 while adjusting the molten metal temperature immediately before casting to be the liquidus temperature (650° C.) or above.

The cast members corresponding to each sample obtained as mentioned above were cut into a specified length, and then subjected to a homogenization treatment under the conditions shown in Table 2. Next, the continuously cast round bar after the homogenization treatment was cut, and subjected to extrusion processing to obtain a round bar having a diameter of 70 mm with an indirect extruder. Furthermore, the extruded member having a round bar shape is cut into a 60 mm length. After being preheating under the conditions shown in Table 2, the extruded member was upset from the side surface of the round bar to have a thickness of 35 mm. Thereafter, the upset product (forged product) was subjected to a T6 heat treatment under the conditions shown in Table 2. Thus, the forged product samples corresponding to Corresponding Examples 1 to 3 were produced.

<Evaluation>

TABLE 3

| | | Anisotropy of plastic deformation | Existence of cracking, hole defects | Average crystal grain diameter | DAS | Coarse recrystallication Surface | Coarse recrystallication Inside | Tensile strength L | Tensile strength LT | Tensile strength LT/L | 0.2 proof stress L | 0.2 proof stress LT | 0.2 proof stress LT/L | Elongation of after fracture L | Elongation of after fracture LT | Elongation of after fracture LT/L | Stress corrosion cracking |
|---|---|---|---|---|---|---|---|---|---|---|---|---|---|---|---|---|---|
| Example | 1 | No | NO | 7.8 | 35 | NO | NO | 444 | 451 | 1.02 | 395 | 398 | 1.01 | 11.5 | 11.3 | 0.98 | NO |
| | 2 | No | NO | 7.0 | 31 | NO | NO | 431 | 433 | 1.00 | 381 | 383 | 1.01 | 13.6 | 13.3 | 0.98 | NO |
| | 3 | No | NO | 7.1 | 34 | NO | NO | 415 | 416 | 1.00 | 367 | 365 | 0.99 | 15.0 | 14.8 | 0.99 | NO |
| | 4 | No | NO | 7.5 | 35 | NO | NO | 438 | 439 | 1.00 | 389 | 388 | 1.00 | 11.1 | 11.3 | 1.02 | NO |
| | 5 | No | NO | 7.1 | 32 | NO | NO | 433 | 432 | 1.00 | 380 | 381 | 1.00 | 13.2 | 13.3 | 1.01 | NO |
| | 6 | No | NO | 7.3 | 33 | NO | NO | 445 | 444 | 1.00 | 395 | 396 | 1.00 | 15.2 | 15.3 | 1.01 | NO |
| | 7 | No | NO | 7.7 | 31 | NO | NO | 448 | 449 | 1.00 | 396 | 393 | 0.99 | 14.9 | 14.8 | 0.99 | NO |
| Comparative Example | 1 | YES | NO | 15.2 | 72 | NO | NO | 471 | 429 | 0.91 | 431 | 379 | 0.88 | 13.4 | 9.5 | 0.71 | NO |
| | 2 | YES | NO | 12.3 | 74 | NO | NO | 447 | 415 | 0.93 | 401 | 362 | 0.90 | 14.5 | 10.5 | 0.72 | NO |
| | 3 | YES | NO | 10.0 | 75 | NO | NO | 430 | 398 | 0.93 | 388 | 352 | 0.91 | 15.9 | 12.0 | 0.75 | NO |
| | 4 | NO | NO | 6.8 | 35 | NO | NO | 372 | 370 | 0.99 | 308 | 310 | 1.01 | 15.5 | 15.5 | 1.00 | NO |
| | 5 | Immeasurable | Cracking | 6.9 | 32 | NO | NO | Immeasurable due to occurrence of cracking | | | | | | | | | |
| | 6 | NO | NO | 7.0 | 32 | YES | YES | 430 | 432 | 1.00 | 371 | 369 | 0.99 | 5.4 | 5.6 | 1.04 | Cracking |
| | 7 | Orange peel occurred | Minute cracking occurred | 7.1 | 34 | Ingot insufficient refinement | | 431 | 431 | 1.00 | 375 | 372 | 0.99 | 7.5 | 7.4 | 0.99 | NO |
| | 8 | NO | NO | 7.0 | 33 | NO | NO | 391 | 390 | 1.00 | 352 | 354 | 1.01 | 15.1 | 15.4 | 1.02 | NO |
| | 9 | NO | Hole defect | 7.8 | 35 | NO | NO | Immeasurable due to occurrence of hole defects | | | | | | | | | |
| | 10 | Immeasurable | Cracking | 7.8 | 35 | NO | NO | Immeasurable due to occurrence of cracking | | | | | | | | | |
| | 11 | NO | NO | 7.8 | 35 | NO | NO | 370 | 369 | 1.00 | 310 | 308 | 0.99 | 15.8 | 16.0 | 1.01 | NO |
| | 12 | Orange peel occurred | NO | 8.5 | 56 | Ingot insufficient refinement | | 417 | 419 | 1.00 | 369 | 370 | 1.00 | 9.5 | 9.1 | 0.96 | NO |
| | 13 | Orange peel occurred | Minute cracking occurred | 15.4 | 45 | Ingot insufficient refinement | | 431 | 430 | 1.00 | 370 | 369 | 1.00 | 6.5 | 6.6 | 1.02 | NO |
| | 14 | NO | NO | 7.9 | 36 | NO | NO | 455 | 453 | 1.00 | 398 | 396 | 0.99 | 10.5 | 10.3 | 0.98 | Cracking |
| | 15 | NO | NO | 7.9 | 33 | NO | NO | 458 | 456 | 1.00 | 401 | 400 | 1.00 | 9.5 | 9.4 | 0.99 | Cracking |
| | 16 | No | NO | 7.1 | 32 | NO | NO | 432 | 433 | 1.00 | 382 | 383 | 1.00 | 13.6 | 13.5 | 0.99 | NO |
| | 17 | Orange peel occurred | NO | 12.1 | 59 | Ingot insufficient refinement | | 433 | 431 | 1.00 | 372 | 375 | 1.01 | 7.5 | 7.2 | 0.96 | NO |
| | 18 | Orange peel occurred | NO | 12.5 | 55 | Ingot insufficient refinement | | 440 | 442 | 1.00 | 392 | 390 | 0.99 | 7.3 | 7.7 | 1.05 | NO |
| | 19 | Orange peel occurred | NO | 12.9 | 59 | Ingot insufficient refinement | | 439 | 440 | 1.00 | 392 | 391 | 1.00 | 7.1 | 6.4 | 0.90 | NO |

* In Comparison Example 16, it was confirmed that there existed a number of Ti series intermetallic compounds.

In Table 3, the unit for each measured value are as follows: average crystal diameter: [μm], DAS: [μm], tensile strength: [MPa], 0.2% proof stress: [MPa], and breaking elongation: [MPa].

As shown in Table 3, as to the obtained samples (forged product samples), the measurement of the hypothetical upset product obtained by upsetting by a simulation and the measurement of the forged product sample obtained by actual upsetting were compared. When the difference in measurement with respect to the simulation result was 1% or less, it was denoted as "NO" meaning that there existed no anisotropy of plastic deformation, and when the difference was more than 1%, it was denoted as "YES" meaning that there existed anisotropy of plastic deformation.

The surface unevenness occurred on a free surface of the material not restrained by a molding die during the upsetting was measured with a surface roughness measuring instrument by stylus method (JIS B 0651). It was denoted as "Orange peel occurred" when the 10 point average roughness Rz (JIS B 0601) was 100 μm or more.

Then, after confirming whether or not there existed breakages and hole defects on the surface of the sample with a solvent removal performance penetrant test (color check), the sample was cut and the cross section was polished. Furthermore, microstructure inspection of the polished sample was conducted to measure the average crystal grain diameter [μm].

In measuring the size of the crystal to determine the average crystal grain diameter, the microstructure was identified with an image analysis equipment (LUZEX) having a microscope, and the cross-sectional area of each crystal was converted to a cross-sectional area of a circle, and the diameter of the circle was deemed as the grain diameter. Furthermore, the average grain diameter was determined by averaging grain diameters of crystals existing within the range of 230×300 μm.

Furthermore, the polished sample was etched, inspected with a metallurgical microscope, and the DAS [μm] was measured. The measurement method of the DAS was performed in accordance with "Dendrite arm spacing measurement procedure" described in "Light Metal (1988), vol. 38, No. 1, p 45" issued by Japan Institute of Light Metals.

Further, during the microscopic inspection, it was also confirmed whether or not there exists Ti series intermetallic compounds which deteriorate machinability.

Furthermore, each sample was inspected with a metallurgical microscope in which a polarized glass was inserted in a light path to determine whether or not coarse recrystallizations exist on the surface and the inner portion of the sample. In measuring the crystal grain diameter, a section method was employed on a photomicrograph. In cases where there existed coarse recrystallized grains of 500 μm or larger, it was judged that there existed coarse recrystallized grains and denoted as "YES," and in cases other than the above cases, it was judged that there existed no coarse recrystallized grains and denoted as "NO."

Furthermore, in each sample, JIS14A proportional test pieces were obtained from a direction (L direction) parallel to the longitudinal direction of the original material and a direction (LT direction) perpendicular to the longitudinal direction of the original material, and the tensile strength [MPa], 0.2% proof stress [MPa], and breaking extension [MPa] thereof were measured.

As an index showing fracture tearing, the characteristic deterioration ratio in the LT direction with respect to the L direction was calculated.

In addition, a test piece of 2 mm×4.3 mm×42.4 mm was cut out from an upset product (forged product sample), and a stress corresponding to 70% of the proof stress was applied at the center portion of the surface of 4.3 mm×42.2 mm using a 3 point bending jig. When applying the stress, the test piece and the jig were electronically insulated. As a corrosive liquid, a liquid in which 36 g of chromic oxide (IV), 30 g of potassium bichromate, and 3 g of sodium chloride were dissolved per 1 liter of pure water and held at 95 to 100° C. was prepared. After immersing the test piece to which the stress was applied in the corrosive liquid for 16 hours, the appearance of the test piece was inspected for occurrence of breakage.

<Results>

As to Examples 1 to 7, since they satisfied all requirements of the present invention, and they were free from anisotropy of plastic deformation, so no breakage and no hole defect of test piece occurred, and no coarse recrystallization was not found on the surface and in the inner portion. Further, as to the tensile strength, 0.2% proof stress, and breaking extension, excellent characteristics was obtained. The characteristic deterioration ratio was as small as within ±5% in the LT direction with respect to the L direction, the fracture tearing performance was excellent, and no stress corrosion cracking occurred.

In contrast, in Comparative Examples 1 to 3, since extruded materials were used as forging materials, there was anisotropy of plastic deformation, and the tensile strength in the LT direction with respect to the L direction, the 0.2% proof stress, and the elongation after fracture were decreased. Especially, the decreasing rate of the elongation after fracture was increased.

Further, in Comparative Examples 1 to 3, since the casting rate did not satisfy the condition of ([maximum casting rate (mm/min)]≤−1.43×[casting diameter (mm)]+500), the DAS value exceeded 40 μm, and therefore the average crystal grain size exceeded 8 μm, which further worsened the anisotropy of plastic deformation.

In Comparative Example 4, since the additive amount of Mg and Zn was insufficient, the tensile strength and the 0.2% proof stress were deteriorated.

In Comparative Example 5, since the additive amount of Fe and Mn was excessive, Al—Fe—Mn series coarse crystallized substances were generated, the average crystal grain size was increased. For this reason, breakages occurred from the crystallized substances during the casting.

In Comparative Example 6, since the additive amount of Zr was insufficient, coarse recrystallization occurred on the surface and inside the upset product (sample), which deteriorated in appearance quality. Further, the elongation after fracture was deteriorated and stress corrosion cracking occurred.

In Comparative Example 7, since the additive amount of Ti was small and that it fails to meet the requirement of the mass ratio of Zr to Ti ([Ti amount]/[Zn amount]) is 0.2 or more, orange peel occurred. The reason is assumed that Zr forms a compound with Ti, constituting a limiting factor of Ti ingot refinement effect, which in turn results in coarse crystal grains. In the tensile test, the elongation after fracture was deteriorated.

In Comparative Example 8, although the additive amount of Zn was large, the additive amount of Mg corresponding to Zn was small. Therefore, the precipitation strengthening of the main reinforcing element was not performed sufficiently, resulting in deterioration of tensile strength and 0.2% proof stress.

In Comparative Example 9, since the homogenization treatment temperature was too high, eutectic melting occurred, which caused hole defects on the surface of the sample.

In Comparative Example 10, since the forging temperature was too low, threshold cracking occurred.

In Comparative Example 11, since the solution heat treatment temperature was too low, sufficient solution of the precipitation strengthening elements was not performed, resulting in insufficient precipitation amount, which deteriorated the tensile strength and the 0.2% proof stress.

In Comparative Example 12, since the casting diameter was large, the DAS became large, resulting in deteriorated elongation. Furthermore, since it failed to meet the condition of ([maximum casting rate] (mm/min)≤−1.43×[casting diameter (mm)]+500), the DAS value exceeded 40 μm. As a result, the average crystal grain diameter exceeded 8 μm, resulting in occurrence of orange peel.

In Comparative Example 13, since the casting diameter was large, the DAS became large, resulting in deteriorated elongation. Furthermore, since it failed to meet the condition of ([maximum casting rate] (mm/min)≤−1.43×[casting diameter (mm)]+500), the DAS value exceeded 40 μm, and the total additive amount of elements other than aluminum was rather large. Furthermore, in addition, due to inappropriate conditions such that the diameter of the cast bar was large, the average crystal grain diameter exceeded 8 μm considerably. As a result, orange peel occurred, causing minute cracking at portions where the surface roughness was larger.

In Comparative Example 14, since the amount of Zn was excessive, a great amount of phases less noble than aluminum was precipitated at grain boundaries, and stress corrosion cracking occurred.

In Comparative Example 15, since the amount of Mg was excessive, elongation deteriorated, In the same reason as in Comparative Example 14, stress corrosion cracking occurred.

In Comparative Example 16, since a total amount of [Zr amount]+[Ti amount] was 0.2 mass % or more, a number of Ti series intermetallic compounds, which cause abrasion of a tool and/or generation of burrs at the time of obtaining a forging material from a cast member or machining a forged product to finish into a final shape, were observed under optical microscope.

In Comparative Examples 17 to 19, since the casting rate with respect to the casting diameter was too fast, the crystal grain diameter and the DAS became large, resulting in deteriorated elongation. Furthermore, since it failed to meet the condition of ([maximum casting rate] (mm/min)≤−1.43×[casting diameter (mm)]+500), the DAS value exceeded 40 μm. As a result, the average crystal grain diameter exceeded 8 μm, resulting in occurrence of orange peel.

On the other hand, even evaluating the aforementioned examples from the view point of casting technology, it is understandable that the casting members of Examples are preferable as casing materials.

That is, the casting material used as a forging material is required to meet the conditions of, e.g., (1) no stress corrosion cracking occurs, (2) it is a predetermined value (400 [MPa]) or more in strength, and (3) no cracking occurs.

However, Comparative Examples 4, 5, 6, 8, 9, 11, 14 and 15 fail to meet any one of the aforementioned conditions (1) to (3).

Comparative Example 10 related to the casting conditions, and was the same as a cast product in Example 1. In Comparative Example 16, since a number of intermetallic compounds generated, it cannot be used as a forging material in terms of machining.

Further, in Comparative Examples 1 to 3, the fracture tearing (LT/L) was less than 0.95, and poor in anisotropy of plastic deformation. Therefore, it is unsuitable for a forging material.

Further, in Comparative Examples 7, 12, 13, and 17, since orange peel occurred, at least anisotropy of plastic deformation existed inherently. Therefore, it is unsuitable for a forging material. In detail, in Comparative Examples 12 and 17, the DAS was 40 μm or less, the elongation was less than 0.96 MPa. Further, in Comparative Examples 12 and 17, the casting rate was insufficient. Further, in Comparative Examples 7 and 13, the composition was inappropriate. As a result, in Comparative Examples 7, 12, 13 and 17, the elongation fails to meet the preferable value of 0.96 or more, resulting in occurrence of orange peel.

On the other hand, in Examples 1 to 7, all of the measurement results were satisfactory, and the aforementioned conditions (1) to (3) required for a forging material were satisfied. Therefore, it can be preferably used as a forging material.

As will be apparent from the aforementioned Examples, according to the present invention, an Al—Zn—Mg series aluminum alloy forged product less in anisotropy of plastic deformation and excellent in fracture tearingy and preferably used for high-strength welding structural members can be obtained. Furthermore, an aluminum alloy forged product excellent in fracture tearing and preferably used for high-strength welding structural members can be obtained. The present invention claims priority to Japanese Patent Application No. 2009-111072 filed on Apr. 30, 2009, the entire disclosure of which is incorporated herein by reference in its entirety.

It should be understood that the terms and expressions used herein are used for explanation and have no intention to be used to construe in a limited manner, do not eliminate any equivalents of features shown and mentioned herein, and allow various modifications falling within the claimed scope of the present While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

INDUSTRIAL APPLICABILITY

The production method of an aluminum alloy cast member according to the present invention can be applicable to a forging technique for producing a high-quality aluminum alloy forged product.

DESCRIPTION OF THE REFERENCE NUMERALS

1 . . . motorcycle frame (forged product)

The invention claimed is:

1. A production method of an aluminum alloy cast member, the method comprising:

a step of obtaining an aluminum alloy melt having an alloy composition consisting of Fe: 0.2 to 0.35 mass %, Cu: 0.05 to 0.20 mass %, Mn: 0.3 to 0.6 mass %, Mg: 1.3 to 2.0 mass %, Zn: 4.6 to 5.1 mass %, and Zr: 0.1 mass % or more, a sum of Zr and Ti being 0.2 mass % or less, the composition satisfying a relation of ([Mg mass %]≥−0.5×[Zn mass %]+3.8) and a relation of ([Ti mass %]/[Zr mass %]≥0.2), and the balance being aluminum and inevitable impurities;

a step of obtaining an aluminum alloy ingot having a structure that has a secondary dendrite arm spacing (DAS) of 40 μm or less and an average crystal grain diameter of 8 μm or less by continuously casting the aluminum alloy melt at a casting rate satisfying a condition of ([maximum casting rate (mm/min)]≤−1.43×casting diameter (mm)+500); and a step of obtaining an aluminum alloy cast member by subjecting the aluminum alloy ingot to a homogenization treatment for holding the ingot for 1 hour at a temperature of 450 to 600° C.

2. A production method of an aluminum alloy forging material characterized in that the aluminum alloy cast member produced by the production method as recited in claim 1 is used as a forging material to be subjected to forging.

3. A production method of an aluminum alloy forged product characterized in that the aluminum alloy cast member produced by the production method as recited in claim 1 is subjected to hot forging to thereby produce the aluminum alloy forged product.

4. The production method of an aluminum alloy forged product as recited in claim 3, wherein the hot forging is executed under a temperature condition of 350 to 500° C.

5. The production method of an aluminum alloy forged product as recited in claim 3, wherein the aluminum alloy forged product is subjected to a solution treatment under a temperature condition of 400 to 500° C.

6. An aluminum alloy cast member obtained by subjecting an aluminum alloy ingot to a homogenization treatment for holding the ingot for 1 hour or more at a temperature of 450 to 600° C., wherein the aluminum alloy ingot has a structure having a secondary dendrite arm spacing (DAS) of 40 μm or less and an average crystal grain diameter of 8 μm or less and obtained by continuously casting an aluminum alloy melt at a casting rate satisfying a condition of ([maximum casting rate (mm/min)]≤−1.43×[casting diameter (mm)]+500), and wherein the aluminum alloy melt has an alloy composition consisting of Fe: 0.2 to 0.35 mass %, Cu: 0.05 to 0.20 mass %, Mn: 0.3 to 0.6 mass %, Mg: 1.3 to 2.0 mass %, Zn: 4.6 to 5.1 mass %, and Zr: 0.1 mass % or more, a sum of Zr and Ti being 0.2 mass % or less, the composition satisfying a relation of ([Mg mass %]≥−0.5×[Zn mass %]+3.8) and a relation of ([Ti mass %]/[Zr mass %]≥0.2), and the balance being aluminum and inevitable impurities.

* * * * *